United States Patent [19]

Curran

[11] 4,221,065

[45] Sep. 9, 1980

[54] FIRING MECHANISM FOR REVOLVERS

[75] Inventor: Roger J. Curran, Stratford, Conn.

[73] Assignee: Bangor Punta Operations, Inc., Greenwich, Conn.

[21] Appl. No.: 930,276

[22] Filed: Aug. 2, 1978

[51] Int. Cl.[3] ..... F41C 1/00

[52] U.S. Cl. ..... 42/65; 42/59

[58] Field of Search ..... 42/65, 59

[56] References Cited

U.S. PATENT DOCUMENTS

| | | | |
|---|---|---|---|
| 314,067 | 3/1885 | Smith | 42/65 |
| 903,919 | 11/1908 | Torkelson | 42/65 |
| 1,007,709 | 11/1911 | Leggett et al. | 42/65 |
| 3,049,977 | 8/1962 | Reich | 42/65 |
| 3,738,042 | 6/1973 | Ruger et al. | 42/65 |

*Primary Examiner*—Charles T. Jordan

*Attorney, Agent, or Firm*—Patrick J. Walsh

[57] ABSTRACT

Disclosed is a firing mechanism for revolvers having a firing pin and a limit pin each movable by the hammer to engage the cartridge and cooperable to limit the extent of penetration of the firing pin into the cartridge. The limit pin engages the rim of the cartridge casing substantially simultaneously as the primer cup is struck and the cartridge is fired. The extent of penetration of the firing pin into the primer cup is predetermined and does not vary between long and short cartridges. The limit pin further retains the cartridge casing in the revolver chamber initially upon firing to permit maximum radial expansion of the casing while the cartridge casing lies fully seated in the forwardmost position in the chamber. Upon postfiring rebound, the cartridge casing elastically recovers sufficiently to provide a clearance space between the walls of the casing and the cylinder chamber to prevent jamming of the casing in the chamber.

13 Claims, 5 Drawing Figures

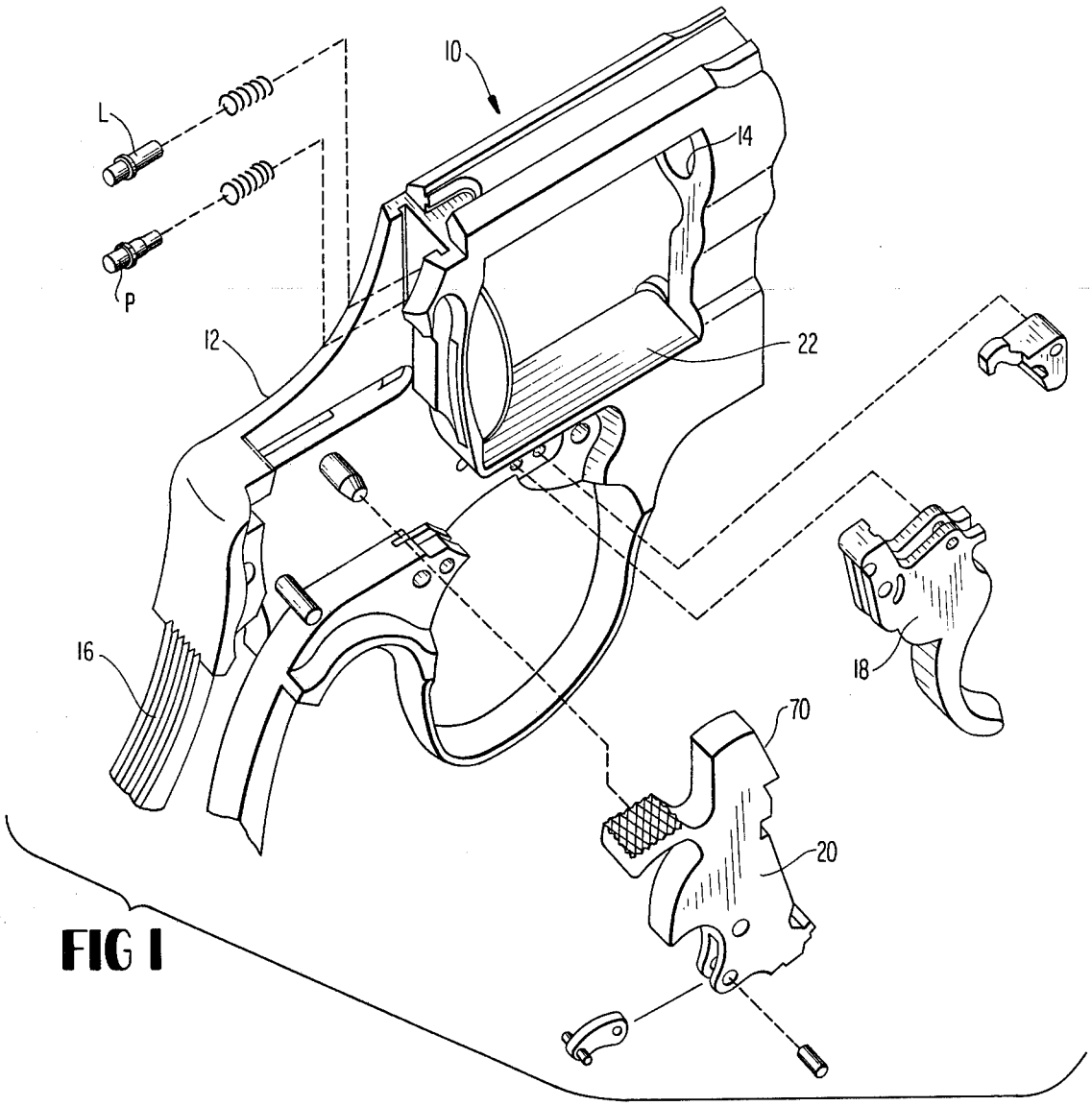
FIG 1
FIG 2
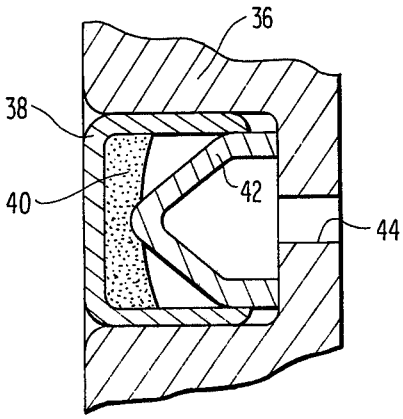
FIG 2A
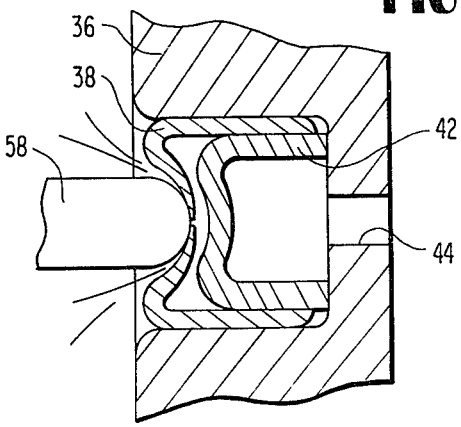

FIRING MECHANISM FOR REVOLVERS

BACKGROUND OF THE INVENTION

The present invention relates to a firing mechanism for a revolver and particularly relates to a firing mechanism which minimizes or eliminates misfires due to wear of the firing pin caused by high pressure gas cutting and jams of the cartridge casings in the chambers of the revolver cylinder caused by postfiring rebound of the casings into the chambers.

Conventional firing mechanisms for revolvers normally have a firing pin carried by the revolver frame for movement between a non-firing position retracted rearwardly of the bolster face and a firing position in which the pin is projected by the hammer across the headspace between the bolster face and the base of the cartridge for penetration of the cartridge base. Particularly, at the end of its forward travel, the firing pin strikes and intrudes or penetrates the primer cup to ignite the primer charge and the main powder charge. Upon ignition of the main powder charge within the cartridge casing, the developing high pressure gases cause the cartridge casing to expand radially and simultaneously move axially rearwardly toward the bolster face.

Frequently, the action of the firing pin when striking the primer cup and/or the displacement of the cartridge casing rearwardly with the firing pin causes the metal of the primer cup to work and stretch. This generates holes in the worked and stretched metal primer cup which permit leakage of the high pressure gas about the firing pin. This, in turn, causes a gas-cutting action on the firing pin. That is, the high pressure gas leaked from the primer cup removes sufficient metal from the firing pin to often quickly dull the firing pin and reduce its effectiveness in subsequently firing primers. Particularly, the gas-cutting action erodes and causes a malshaping of the firing pin tip which can and does result in subsequent misfiring of the revolver. The damage to the firing pin is also progressive as the revolver is repeatedly fired resulting in the increasing occurrence of misfires.

Considered from another standpoint, the bullet and the cartridge casing are separated upon ignition. Since the casing weighs less than the bullet, it accelerates rearwardly at a higher velocity than the bullet moves forwardly. When the casing reaches the bolster face of the revolver, the bullet moves forwardly at high velocity for passage through the revolver barrel. The firing pin is conventionally coupled to the hammer. The firing pin and hammer are the only mechanically coupled mechanism for preventing rearward movement of the casing. While the mass of the hammer is heavier than that of the bullet, the surface contact between the firing pin and the primer cup is not large enough to move the hammer backwards in time to retract the firing pin without excessive metal deformation and working of the metal of the primer cup and consequent piercing of the primer cup. A shortening of the firing pin to avoid excessive metal working and deformation can stop the piercing action and consequent gas cutting and erosion of the firing pin. However, if the firing pin is shortened, its protrusion is not great enough to permit striking contact with the primer cup and sufficient penetration of all cartridges of varying lengths, particularly those having relatively short lengths, as discussed below. The problem of misfiring would thus not be cured.

While firing pin erosion occurs to a greater or lesser extent in most of the different types of revolvers, the problem of firing pin erosion in particularly acute in the 9 mm. revolver. In comparison with other cartridges, the 9 mm. cartridge is a higher pressure cartridge which can generate pressures within its casing as high as 40,000 lbs/in$^2$. This high pressure also indicates appreciably higher gas temperatures inside the cartridge casing than other cartridges. Also, the rate at which pressure is developed in the 9 mm. cartrige is very high. This combination of high pressure and temperature causes the gas escaping through the pierced primer cup at a high rate to very quickly erode the firing pin, even more so than occurs with respect to the firing pins in other types of revolvers.

Cartridges for revolvers also vary in length. Thus, the distance from the bolster face to the base of the cartridge, e.g. the headspace, when the cartridge is fully seated forwardmost in the chamber of the revolver cylinder, varies substantially from cartridge to cartridge as the revolver cylinder is rotated to register the cartridges in firing position. This is particularly true of the 9 mm. cartridge. The gas cutting and erosion of the firing pin is exacerbated the greater the headspace. For example, it will be appreciated that the base of a cartridge of relatively short length, when fully seated forwardmost in its cylinder chamber, will be spaced from the bolster face a greater distance than the spacing between the base of a longer cartridge and the bolster face. Consequently, for cartridges of relatively short lengths, the firing pin has a greater distance, e.g. headspace, to travel to strike the primer cup than the distance traveled by the firing pin when firing cartridges of greater length. More importantly, the cartridge casing of the shorter cartridge has a greater distance to move rearwardly toward the bolster face when the cartridge is fired than does the casing of the relatively longer cartridge when it is fired. When a short cartridge casing moves rearwardly in a revolver having a conventional firing mechanism, it carries the firing pin with it this greater distance causing further stretching and working of the metal of the primer cup than would otherwise be the case for a longer cartridge casing. Consequently, there is a substantially greater tendency to pierce the primer cup and leak high pressure gas about and thereby erode the firing pin in the case of short cartridges. Also, the headspace tends to increase with gun wear further excerbating the problem of piercing the metal of the primer cup and releasing the high pressure gas about the firing pin.

In automatics, an open bolt-type firing pin system is utilized. There, a firing pin is integral with the face of the bolt and is fixed to have a small protrusion ahead of the bolt. The bolt and firing pin are essentially one piece and the bolt reaches out and strikes the rear of the casing. Misfires will not frequently occur and the firing pin protrusion can be kept to a limit which does not permit piercing. However, this system is not applicable to revolvers.

Further, as the high pressure gas resulting from firing the cartridge exerts a radial pressure on the casing and the casing moves rearwardly, the cartridge casing tends to radially enlarge and correspond to the slight rearward taper of the cylinder chamber. On rebound of the hammer and firing pin, the casing is displaced forwardly by and with the firing pin. As a result, there is a tendency of the radially enlarged tapered casing to jam or stick in the chamber on postfire rebound. This problem is exacerbated in shorter cartridges because the greater the rearward distance of travel of the casing, the greater the radial expansion and the greater the tendency for the casing to bind or jam when displaced forwardly on postfire rebound. The elastic recovery of the casing toward its original size is insufficient to permit the casing to fully seat in the chamber in the same position before firing. Soft casings, for example brass, have particularly insufficient elastic recovery. Thus, there is a further tendency for casings formed of soft materials to stick or jam within the chamber upon postfiring rebound.

SUMMARY OF THE PRESENT INVENTION

The present invention provides a novel and improved firing mechanism for revolvers which minimizes or eliminates many of the foregoing and other problems associated with the firing mechanisms of conventional revolvers and provides a novel and improved firing mechanism for revolvers having various advantages in construction, mode of operation and result in comparison with such conventional firing mechanisms. Particularly, the present firing mechanism for revolvers includes a device engageable with the cartridge being fired to limit the extent of penetration or intrusion of the firing pin into the cartridge upon firing. This minimizes or eliminates the tendency of the metal of the primer cup to work and stretch and to be pierced with resultant erosion of the firing pin by leakage of the high pressure gas. Hence, misfires are avoided by increasing the reliability and performance of the firing pin. Further, this same device supports the cartridge momentarily in its forwardmost or fully seated position in the cylinder chamber when the cartridge is fired for a sufficiently long period of time to enable maximum radial expansion of the casing while fully seated forwardmost in the chamber. Consequently, when the casing moves rearwardly toward the bolster face, its maximum expansion has previously occurred and its normal elastic recovery enables it to be displaced forwardly upon rebound of the hammer and firing pin without danger of jamming into or forming a press-fit in the chamber.

More particularly, the firing mechanism of the present invention includes a firing pin carried by the revolver frame for movement of its tip from a retracted position substantially flush with the bolster face into a firing position projecting forwardly of the bolster face for striking the primer cup of the cartridge. A limit pin is also carried by the frame for similar movement of its tip from a retracted position substantially flush with the bolster face into a position forwardly of the bolster face and into engagement with the rim of the cartridge being fired. Both the firing pin and limit pin are struck by the hammer to move them into their forwardmost positions. The firing pin is configured such that, when struck by the hammer, it is projected forwardly to strike the primer cup and penetrate the plane of the base of the cartridge just before the limit pin engages the rim of the cartridge after it has been projected forwardly by the hammer. This enables a high energy transfer to occur between the firing pin and primer cup sufficient to ignite the powder in the primer cup before the limit pin engages the cartridge rim to limit the extent of penetration of the firing pin into the primer cup and forwardly of the plane of the base of the cartridge.

When the cartrigde casing is displaced rearwardly after this initial dwell time, it displaces the limit pin rearwardly which, in turn, pushes the hammer back. This enables the firing pin to follow the movement of the hammer and retract with it and the limit pin. Consequently, the penetration of the firing pin into the primer cup is limited to the slight difference in forward protrusion of the firing pin beyond the limit pin when both are projected forwardly into engagement with the cartridge. This minimizes or eliminates the tendency of the metal of the primer cup to malform, shape, and work since the casing carries the firing pin rearwardly with it but without the resistance of the hammer. Consequently, the resultant gas-cutting and erosion of the firing pin caused by the metal piercing action is eliminated.

Further, the mass of the hammer, when in its forwardmost position, in engagement with both the limit pin and firing pin enables the cartridge casing to be maintained fully seated in the forwardmost portion of the chamber when the cartridge is fired for a period of time approximating the time required for the powder within the casing to obtain its peak internal pressure. That is, the limit pin prevents initial rearward movment of the casing upon firing. Thus, the casing is sized during its initial high pressure radial expansion while fully seated in the forwardmost portion of the chamber rather than at the rear portion of the chamber in engagement against the bolster face. The limit pin enables the pressure peak to occur in the casing while it remains in its forwardmost fully seated position in the chamber. Consequently very little additional radial expansion, if any, occurs during retreat of the casing toward the bolster face. This momentary maintenance of the casing in the forwardmost portion of the chamber upon firing causes the casing to be slightly smaller in diameter as compared with the diameter it would have obtained if it had moved rearwardly immediately upon firing. After the casing has moved rearwardly and upon postfiring rebound of the casing into the forwardmost portion of the chamber, the elastic recovery of the casing enables the casing to return in a loose fit within the chamber, e.g. with a slight clearance between it and the walls of the chamber. Thus, the casings are not jammed into the chamber upon rebound of the hammer and pins which drive the spent casing forwardly into the chamber.

Accordingly, it is a primary object of the present invention to provide a revolver having a novel and improved firing mechanism which minimizes or eliminates misfires caused by firing pin erosion due to gas-cutting action on the firing pin when the cartridge is fired.

It is another object of the present invention to provide a revolver having a novel and improved firing mechanism which minimizes or eliminates jamming of cartridges in the cylinder chambers due to postfiring rebound.

It is another object of the present invention to provide a revolver having a firing mechanism which ensures like penetration of the firing pin into each cartridge irrespective of the different length of the cartridges.

To achieve the foregoing and other objects and advantages of the present invention as embodied and broadly described herein, the revolver of the present invention comprises a frame, a cylinder with multiple chambers for receiving cartridges and rotatably carried by the frame for selective registration of the cartridges in firing position, means carried by the frame for firing the cartridge in firing position including a firing pin carried for movement between a non-firing first position and second position for penetrating the base of the cartridge registered in firing position to fire the cartridge, means for moving the firing pin into the second position to fire the cartridge in firing position, and means carried by the frame and engageable with the cartridge in firing position for limiting the extent of penetration of the firing pin into the base of the cartridge when the firing pin is moved into its second position.

To further achieve the objects and advantages of the present invention, the revolver hereof comprises a frame having a bolster face, a firing pin carried by the frame for movement between a first non-firing position and a second firing position extending forwardly of the bolster face, a cylinder carried by the frame with multiple chambers for receiving the cartridges and spaced forwardly of the bolster face, the cylinder being rotatably carried by the frame for selective registration of the cartridges in firing position relative to the firing pin, means carried by the frame for moving the firing pin from the first position into the second position to fire the cartridge in firing position, and means carried by the frame and engageable with the cartridge casing for preventing initial movement of the cartridge casing in a direction toward the bolster face when the cartridge is fired by the firing pin.

The accompanying drawings which are incorporated herein and constitute a part of the specification illustrate an embodiment of the invention and, together with the description, serve to explain the purposes of the invention.

BRIEF DESCRIPTION OF THE DRAWINGS

FIG. 1 is a framentary exploded view of a revolver incorporating a firing mechanism constructed in accordance with the present invention;

FIG. 2 is an enlarged fragmentary cross-sectional view of the base of a cartridge and illustrating its primer cup;

FIG. 2A is a view similar to FIG. 2 illustrating a firing pin in contact with the primer cup of the cartridge;

DESCRIPTION OF A PREFERRED EMBODIMENT

Figures 3, 3A:
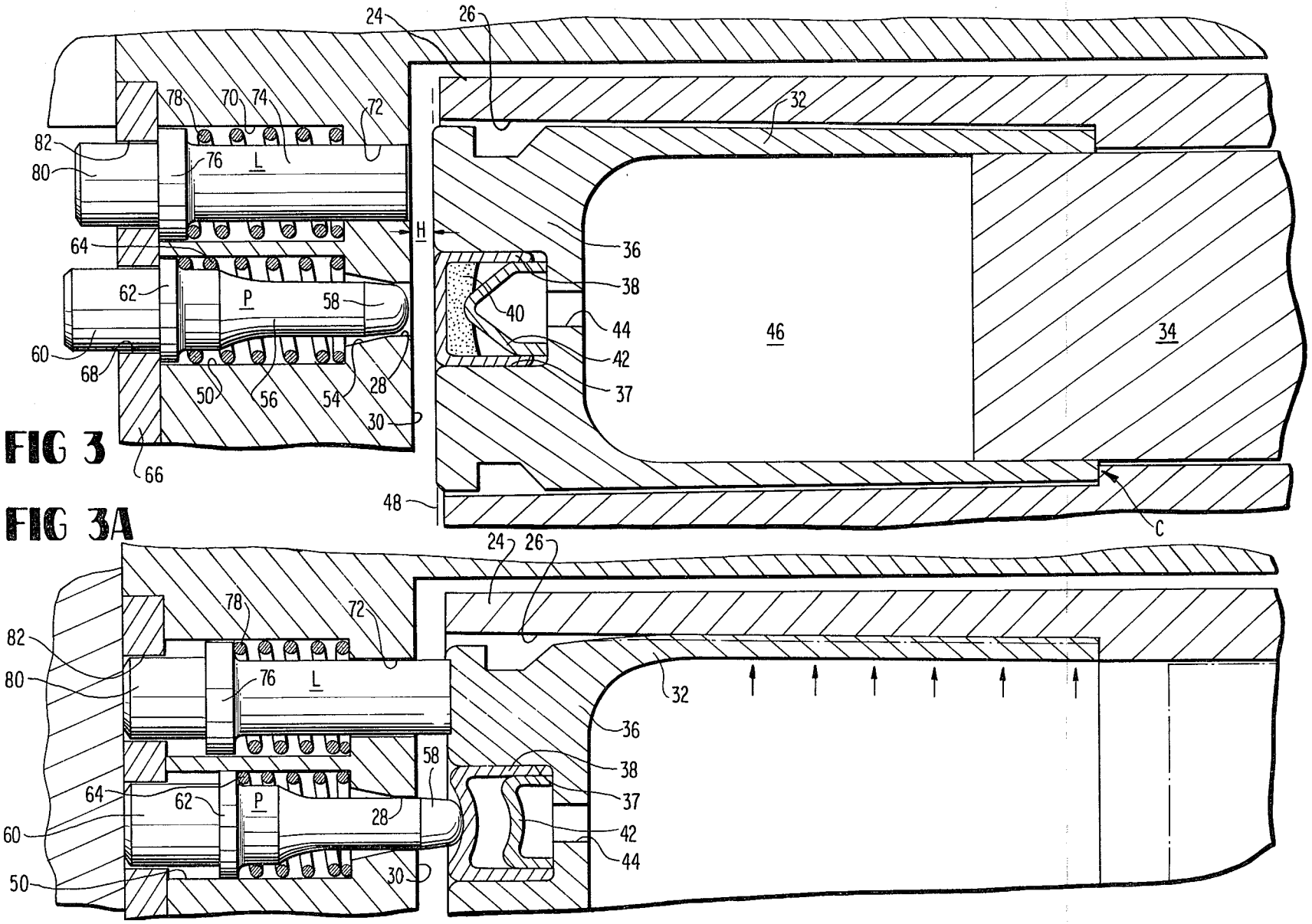
FIG. 3 is an enlarged fragmentary cross-sectional view of the revolver of FIG. 1 illustrating a cartridge in the chamber of the cylinder in position for firing by the firing mechanism hereof.
FIG. 3A is a view similar to FIG. 3 illustrating the cartridge and firing mechanism hereof at the moment of firing.

Reference will now be made in detail to the present preferred embodiment of the invention, an example of which is illustrated in the accompanying drawings.

Referring now to FIG. 1, there is illustrated a revolver, generally designated 10, having a revolver frame 12, a barrel 14, a grip 16, a trigger assembly 18, and a hammer 20. Frame 12 is provided with a recess 22 for rotatably receiving a conventional cylinder 24 having a plurality of circumferentially spaced charge holes or chambers 26 for receiving cartridges generally designated C (See FIGS. 3 and 3A). The cylinder chambers 26 are conventionally slightly tapered in a forward direction. Cylinder 24 is mounted for rotation in frame 12 in a conventional manner by means not shown. It will be appreciated that, upon actuation of trigger assembly 18, cylinder 24 is rotated to selectively register cartridges C in firing position in registration with barrel 14 and in opposition to a firing pin P carried by frame 12 and exposed through an aperture 28 in bolster face 30.

Cartridge C is of conventional construction and, as illustrated in FIGS. 3 and 3A, includes a cartridge casing 32, a bullet 34 and a casing base 36 having a central aperture 37 for receiving a primer cup 38 containing powder 40 and an anvil 42 (See also FIG. 2). An aperture 44 opens from primer cup 38 into chamber 46 containing the main powder charge. When cartridge C is fired, primer cup 38 is struck by a firing pin, for example the firing pin P hereof as illustrated in FIG. 2A, to ignite powder 40 and deform anvil 42 which in turn, ignites the main powder charge within the casing 32.

In a revolver having a conventional firing mechanism, the expanding high pressure gases resulting from ignition of the powder displace the casing rearwardly into engagement with the bolster face and then drives the bullet forwardly through the barrel. As explained previously, this action wears and erodes the firing pin resulting in frequent misfires. Postfiring rebound of the hammer and firing pin also jams the casing within the chambers of the cylinder.

The firing mechanism of the present invention, however, minimizes or eliminates the piercing action on the metal of the primer cup and consequent gas erosion of the firing pin thus avoiding misfires. Also, it initially retains the casing in its forwardmost or fully seated position in the chamber thus minimizing or eliminating the tendency of the casings to stick or jam in the cylinder chambers.

As used herein, the term "headspace" is defined as the linear distance H between the bolster face 30 and the base 48 of cartridge casing 32. Also, the terms "intrusion" or "penetration" are used herein to denote the extent to which the tip of the firing pin extends into the base of the cartridge beyond the plane 48 which extends normal to the axis of the cartridge at its rear end face.

As herein embodied, the firing mechanism of the present invention includes the firing pin P and a limit or retainer pin L. Firing pin P is mounted in a bore 50 formed in frame 12. Bore 50 has a reduced diameter aperture 28 opening through bolster face 30. Bore 50 and aperture 28 are joined by a tapered section 54 to facilitate forward movement of firing pin P as discussed hereinafter. Firing pin P comprises a reduced diameter shank 56 which terminates in a firing tip 58. Firing pin P terminates at its rear end in an enlarged diameter base 60 separated from shank 56 by a further enlarged annular flange 62. A coil spring 64 is received in bore 50 about shank 56. One end of spring 64 bears against the base of bore 50 while its opposite end bears against shoulder 62 for biasing firing pin P for movement in a rearward direction away from cylinder 24 and into its non-firing position illustrated in FIG. 3. Firing pin P is retained in bore 50 by a clip 66 secured to frame 12. Clip 66 has an opening 68 for receiving base 60 and forms an annular shoulder against which flange 62 bears under the bias of spring 64 when the firing pin P lies in its retracted non-firing position as illustrated in FIG. 3. Base 60 projects rearwardly of clip 66, when the firing pin is retracted, for engagement by the flat 70 of hammer 20.

Limit pin L is similarly disposed in a bore 70 having a reduced diameter aperture 72 for receiving the shank 74 of limit pin L. Adjacent the rear end of limit pin L, there is provided an annular flange 76 which is engaged by one end of a coil spring 78 in bore 70, the opposite end of which engages the base of bore 70. Spring 78 thus biases limit pin L for movement in a rearward direction away from cylinder 24. Limit pin L is retained in bore 70 by engagement of flange 76 against the clip 66, the base 80 of limit pin L extending through an opening 82 in clip 66.

As illustrated in FIG. 3, firing pin P is carried by frame 12 in alignment with the center of cartridge C, tip 58 being in axial opposition to primer cup 38. Limit pin L is carried by frame 12 in alignment with the margin or rim of the base of cartridge C and radially outwardly of the primer cup for reasons which will become clear from the ensuing description.

Both limit pin L and firing pin P are illustrated in FIG. 3 in their retracted nonfiring positions. It will be appreciated that the tips of the firing pin P and limit pin L, when the pins are retracted, lie substantially flush with bolster face 30. From a review of FIG. 3, it will also be appreciated that firing pin P is slightly longer in length in comparison with the length of limit pan L and that flange 62 has an axial extent less than the axial extent of flange 76.

In operation, it will be appreciated that the squeezing of trigger 18, by means not shown but conventional, causes hammer 20 to first retract and then move forward. In moving forwardly, the flat 70 of hammer 20 first strikes firing pin P to advance it toward primer cup 38 before limit pin L is struck by the hammer and advanced toward the rim of the cartridge. Consequently, firing pin P traverses headspace H to strike primer cup 38 to penetrate or intrude beyond the plane 48 containing the rear face of the cartridge base 36 before limit pin L engages the rim of cartridge 32. At substantially the time firing pin P causes ignition of cartridge C, limit pin L engages the rim of cartridge base 36. FIG. 3A illustrates the flat 70 of hammer 20 bearing against the back surface of clip 66 and frame 12.

It will be appreciated that FIG. 3A illustrates the maximum distance of travel of pins P and L and that this distance of travel is not always obtained because of variation in the lengths of the cartridges. Thus, this maximum distance of travel of the pins will be obtained only for the very shortest of cartridge casings. For longer cartridges, limit pin L engages the rim of the cartridge casing before hammer 20 engages clip 66 and thus prevents further forward motion of hammer 20 toward clip 66. Since firing pin P is biased by spring 64 for rearward movement, further penetration or intrusion of the firing pin P beyond the extent of its intrusion or penetration relative to the tip of the limit pin illustrated in FIG. 3A is prevented.

It will therefore be realized that firing pin P and limit pin L are sized and configured such that, upon firing, limit pin L limits the extent of penetration or intrusion the tip 58 of firing pin P into primer cup 38 to a predetermined distance. That is, limit pin L cooperates with hammer 20 such that tip 58 penetrates beyond the plane 48 into the base of the cartridge a limited distance substantially equal to the differences in the lengths of limit pin L and firing pin P. This limited distance of penetration beyond plane 48 is the same for cartridges having different lengths.

When the cartridge is fired and after an initial and advantageous dwell time in its forwardmost fully seated position in chamber 26 as explained hereinafter, casing 32 moves rearwardly toward bolster face 30. In moving rearwardly, the casing pushes against limit pin L which, in turn, pushes hammer 20 rearwardly. As hammer 20 is displaced rearwardly, the rearward movement of the primer cup 38 in engagement with tip 58 of firing pin P as well as the bias of spring 64 causes the firing pin to follow the rearward movement of hammer 20 as the latter is displaced rearwardly by the action of the cartridge casing pushing rearwardly against the limit pin. Thus, the extent of penetration of tip 58 beyond plane 48 into the primer cup 38 remains limited as the casing is displaced rearwardly in chamber 26 toward bolster face 30. Importantly, working, deformation and stretching of the metal of primer cup 38 is minimized or eliminated as the casing is displaced rearwardly.

In conventional firing mechanisms, the primer cup tends to force the firing pin P rearwardly against the mass of the hammer causing the metal-to-metal contact between the tip and the primer cup to weaken and stretch the primer cup metal to the point that the primer cup is pierced by the high pressure gas. Gas erosion and cutting of the firing pin tip thus normally occurs resulting in misfires. The firing mechanism of the present invention, however, enables the primer cup merely to follow the retraction of the firing pin P. This action minimizes or eliminates the generation of holes in the primer cup and release of the high pressure gas thus preventing erosion of the firing pin and misfires caused thereby.

Further, by locating limit pin L in engagement between the cartridge and hammer upon firing, cartridge casing 32 is maintained fully seated at least initially in the forwardmost part of chamber 26 as the pressure of the expanding gases within the cartridge casing rises. The tendency of these high pressure gases to displace the cartridge rearwardly toward bolster face 30 is thus initially arrested enabling the pressure rise within the cartridge to approximate its peak while fully seated in its forwardmost position in the chamber and before the start of its rearward movement.

Importantly, since the peak pressure within the cartridge casing occurs while the casing is forwardly in the chamber 26, radial expansion of the casing is substantially complete before the casing is displaced rearwardly. It will be appreciated that after the casing is displaced rearwardly, the hammer rebounds against limit pin L and firing pin P to move casing 32 forwardly in chamber 26 for return to its forwardmost fully seated position. Since the maximum radial expansion of the cartridge has occurred during the peak pressure rise when the cartridge was previously forwardmost in chamber 26, and because substantially little or no further radial expansion occurs as the casing moves rearwardly in the tapered chamber, the cartridge will readily move forwardly into its previous position forwardmost in chamber 26. Additionally, after the casing radially expands it also elastically recovers. This tends to reduce the diameter of the casing toward its original diameter. This elastic recovery facilitates displacement of the casing forwardly within chamber 26 with a clearance space between the casing and the wall of chamber 26. Thus, the cartridge can be readily removed from the chamber when the revolver is unloaded.

The invention may be embodied in other specific forms without departing from the spirit or essential characteristics thereof. The present embodiment is therefore to be considered in all respects as illustrative and not restrictive, the scope of the invention being indicated by the appended claims rather than by the foregoing description, and all changes which come within the meaning and range of equivalency of the claims are therefore intended to be embraced therein.

I claim:

1. A revolver comprising:

a revolver frame, a cylinder with multiple chambers for receiving cartridges and rotatably carried by said frame for selective registration of the cartridges in a firing position, a bolster face in opposition to the rear face of said cylinder, means carried by said frame for firing the cartridge in firing position including a firing pin carried for movement between a non-firing first position and a second position for firing the cartridge by penetrating its base, means carried by said frame and engageable with the cartridge in firing position including a limit pin carried between a first position and a second position for limiting the extent of penetration of said firing pin into the base of the cartridge when said firing pin is moved into said second position, said bolster face having a pair of apertures for receiving said limit pin and said firing pin, said limit pin and said firing pin being carried for movement through said apertures, and means carried by said frame and engageable with said firing pin and said limit pin for moving said pins into their second positions.

2. A revolver according to claim 1 wherein said firing means further includes a hammer carried by said frame for moving said firing pin and said limit pin into their second positions.

3. A revolver according to claim 1 wherein said firing pin is movable from said first position to said second position through a position intermediate said first and second positions for initially striking the base of the cartridge in firing position before penetration thereof, and means for maintaining said limit pin out of engagement with the cartridge in firing position when said firing pin lies in said intermediate position.

4. A revolver according to claim 1 including means carried by said frame for biasing said firing pin into its first position, said firing pin having a tip for penetrating the cartridge in firing position and lying substantially flush with said bolster face when said firing pin lies in said first position, and means for biasing said limit pin for movement toward its first position, said limit pin having a tip lying substantially flush with said bolster face when said limit pin lies in its first position and engageable with the base of the cartridge in firing position when said limit pin lies in said second position.

5. A revolver according to claim 1 wherein said firing pin is longer in length than said limit pin to enable said firing pin to strike the cartridge in firing position before said limit pin engages the cartridge in firing position.

6. A revolver according to claim 1 wherein the base of the cartridge in firing position defines a plane spaced from and substantially parallel to said bolster face, the tip of said limit pin lying substantially in said plane when said limit pin lies in said second position, the tip of said firing pin being spaced on the side of said plane remote from said bolster face when said firing pin and said limit pin lie in their respective second positions.

7. A revolver according to claim 6 wherein the cartridges have cartridge casings, said limiting means initially preventing movement of the cartridge casing in a direction toward said bolster face when said cartridge is fired.

8. A revolver for firing cartridges having a casing and a bullet comprising:

a revolver frame having a bolster face, a firing pin carried by said frame for movement through said bolster face between a first non-firing position and a second firing position extended forwardly of said bolster face, a cylinder carried by said frame and spaced forwardly of said bolster face, said cylinder having multiple chambers for receiving cartridges, said cylinder being rotatably carried by said frame for selective registration of cartridges in a firing position relative to said firing pin, a limit pin carried by said frame in spaced relation from said firing pin for movement through said bolster face between a first position spaced from the cartridge in firing position and a second position in engagement with the cartridge in firing position for preventing initial movement of the cartridge in a direction toward said bolster face when the cartridge is fired by said firing pin, and moving means carried by said frame and engageable for moving said firing pin and said limit pin into their second positions.

9. A revolver according to claim 8 wherein said bolster face has a pair of apertures for receiving said limit pin and said firing pin.

10. A revolver according to claim 8 wherein said firing pin is movable from said first position to said second position through a position intermediate said first and second positions for initially striking the base of the cartridge in firing positions before penetration thereof, and means for maintaining said limit pin out of engagement with the cartridge in firing position when said firing pin lies in said intermediate position.

11. A revolver according to claim 8 including means carried by said frame for biasing said firing pin into its first position, said firing pin having a tip for penetrating the cartridge in firing position and lying substantially flush with said bolster face when said firing pin lies in said first position, and means for biasing said limit pin for movement toward its first position, said limit pin having a tip lying substantially flush with said bolster face when said limit pin lies in its first position and engageable with the base of the cartridge in firing position when said limit pin lies in said second position.

12. A revolver according to claim 8 wherein said firing pin is longer in length than said limit pin to enable said firing pin to strike the cartridge in firing position before said limit pin engages the cartridge in firing position.

13. A revolver according to claim 8 wherein the base of the cartridge in firing position defines a plane spaced from and substantially parallel to said bolster face, the tip of said limit pin lying substantially in said plane when said limit pin lies in said second position, the tip of said firing pin being spaced on the side of said plane remote from said bolster face when said firing pin and said limit pin lie in their respective second positions.

* * * * *